United States Patent [19]

Zamacola

[11] Patent Number: 4,730,538

[45] Date of Patent: Mar. 15, 1988

[54] SAFETY DEVICE FOR AUTOMATIC FIREARMS

[75] Inventor: Eduardo I. Zamacola, Guipuzcoa, Spain

[73] Assignee: Star Bonifacio Echeverria, S.A., Guipuzcoa, Spain

[21] Appl. No.: 915,553

[22] Filed: Oct. 6, 1986

[30] Foreign Application Priority Data

Apr. 3, 1986 [ES] Spain ..... 553712

[51] Int. Cl.[4] ..... F41D 11/02

[52] U.S. Cl. ..... 89/154; 89/42.03

[58] Field of Search ..... 89/42.03, 149, 150, 89/154

[56] References Cited

U.S. PATENT DOCUMENTS 2,356,727 8/1944 Reising ..... 89/149

*Primary Examiner*—Stephen C. Bentley

*Attorney, Agent, or Firm*—Young & Thompson

[57] ABSTRACT

A safety device for an automatic weapon such as a submachine gun, comprises a safety catch in addition to the sear. The safety catch is mounted for limited longitudinal movement and for vertical swinging movement on the weapon. A spring urges it continuously rearwardly; and in its rearmost depressed position, it is held depressed beneath a detent. The breech block has a triggering hook at its rear end, that releases the safety catch and moves it forwardly against the spring action, toward the end of a firing stroke of the breech block. The safety catch is depressed by a cam surface on the breech block, to the extent that the spring can pull it beneath the detent, only at the rearmost portion of the travel of the breech block, when the sear locks the breech block against unintended forward motion. The breech block has intermediate notches, between that rearmost hook and the cam, which will be engaged by the raised safety catch if the rearward motion of the breech block is incomplete.

1 Claim, 4 Drawing Figures

FIG.1
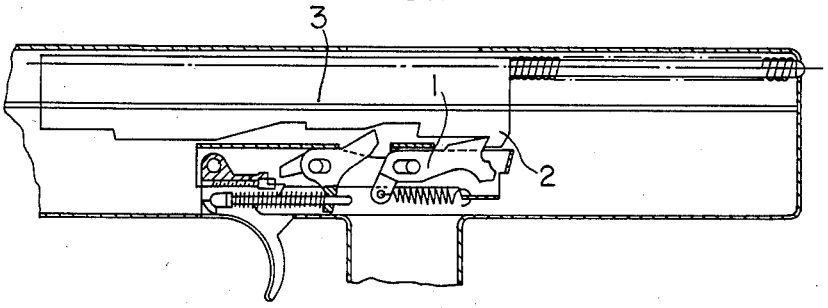
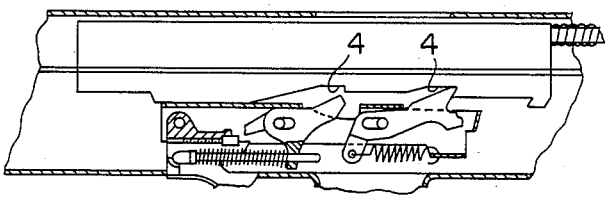
FIG.2
FIG.3
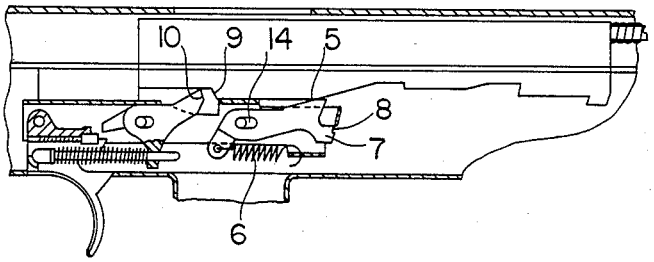
FIG.4
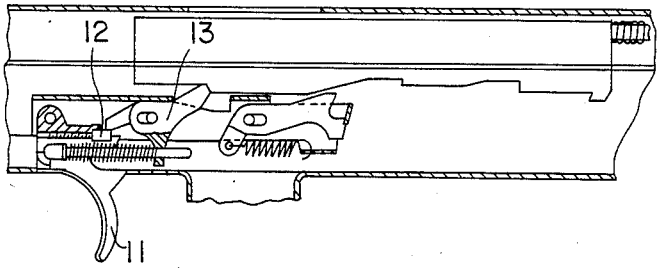

SAFETY DEVICE FOR AUTOMATIC FIREARMS

The invention refers to a safety device to lock automatic firearms, specially for submachine guns working with the system of advanced percussion and which has been designed to avoid accidental shots under the supposition that an incomplete recoil of the breech block would be produced at the moment of striking or due to any other accidental reason.

The realizations known so far about these safety devices are mostly elements placed in the striking or cocking lever which are adapted to block the breech block in an indirect way, but which are inefficient to control the same, when casual movements are produced.

In other cases, the sear is placed, so that it could retain the breech block as soon as it would pass the feeding point which brings about the inconvenience of reducing the extent of its movement towards the breech, weakening the percussion capacity to the prejudice of its working reliability.

The possibility of using two simultaneous sears is also known, of which the one in front is for safety and the other one is placed in the rear, from which the firing is started, both being actuated by the trigger. This procedure has the risk that, on finishing a burst by releasing the pressure on the trigger, the breech block may be retained in the safety catch which produces the same energy loss to strike, as it happened in the previous case. Furthermore, this device does not strictly provide any safety to the weapon, since a shot can be fired by pulling the trigger.

The safety systems based on the presence of key actuation in the buttstock also have been deficient. If the gripped weapon is carried, the safety device is deactivated which brings about the risk that the breech block would casually move enough to reach a cartridge of the loading clip, carry it back to the breech, strike it and discharge it.

These inconveniences can be avoided by means of the design in accordance with the herein described invention, in which an example is given in the schematic and descriptive drawing, applied to an automatic weapon of the machine gun type, in which:

FIG. 1 represents a side elevation of the system at rest.

FIG. 2 shows the position taken by the safety catch relative to the retention notches provided in the breech block, in the course of its recoil, explaining how the recovery movement is interrupted that began at the wrong moment.

The neutralized safety catch appears in FIG. 3.

FIG. 4 shows the system when the weapon is ready to be fired.

Referring to the drawing, when the breech block 3 is in a position of rest, FIG. 1, the safety catch 1 is pushed slightly in a forward direction by the triggering hook 2 of breech block 3 and is free to pivot vertically. In this state, FIG. 2, when the breech block begins to recoil, the safety catch drops into various notches 4 which are distributed along block 3 in the best way possible, as far as their situation and number are concerned. It can be seen in FIG. 3 how the can 5 of the last notch for the safety catch depresses it farther than the previous notches and in this way, it is in condition to move backwards because of the presence of slot 14 and the action of the tension spring 6, being latched by its rear nose 7 under edge 8 of the partition which closes its housing.

When this operation takes place, the shoulder 9 of breech block 3 has already passed beyond the nose 10 of sear 13, fully guaranteeing that the safety catch will be released only when it has been released by the sear.

If the operator pulls the trigger 11, FIG. 4, he will push the sear 13 via the pin 12 which will then release breech block 3, causing its advance because of the passivity of the safety catch in a deactivated position; this advance lasts until the breech block would reach the breech, even in the course of its run, when the sear would have returned to its position of rest because the trigger has been released.

In this way, it is achieved that the weapon at rest automatically has a safety device which prevents the inversion of the breech block recoil, while such a safety does not at all exist, when the striking is completed, allowing the breech block to return from the firing position, free of any prevention.

What I claim is:

1. In an automatic weapon having a reciprocable breech block and sear for releasably holding the breech block in a predetermined rearmost position under the control of a trigger; the improvement comprising a safety catch in addition to the sear, the safety catch being mounted on the weapon for vertical swinging movement and limited longitudinal movement relative to the weapon, spring means urging the safety catch rearwardly, a detent for releasably retaining the safety catch in a lowered rearmost position, the breech block having a triggering hook on the rear thereof that engages and moves forward and raises the safety catch free from engagement with the detent when the breech block reaches its firing position, the breech block having a cam thereon that depresses the safety catch sufficiently, upon rearward movement of the breech block, to enable the spring means to move the safety catch to said lowered rearmost position when the breech block has moved sufficiently far to the rear to enable said sear to selectively prevent forward motion of the breech block until the trigger is pulled, the breech block having at least one downwardly opening notch thereon between said triggering hook and said cam for engagement with said safety catch in a raised position of said safety catch so as to prevent forward movement of the breech block following an incomplete rearward movement thereof.

* * * * *

UNITED STATES PATENT AND TRADEMARK OFFICE

CERTIFICATE OF CORRECTION

PATENT NO. : 4,730,538

DATED : March 15, 1988

INVENTOR(S) : Eduardo IRAEGUI ZAMACOLA

It is certified that error appears in the above—identified patent and that said Letters Patent is hereby corrected as shown below:

On the Title Page

Under the caption "United States Patent", change "Zamacola" to --Iraegui Zamacola--.

In Item 75, change the inventor's name from "Eduardo I. Zamacola" to --Eduardo Iraegui Zamacola--.

Signed and Sealed this

Twelfth Day of July, 1988

*Attest:*

*Attesting Officer*

DONALD J. QUIGG

*Commissioner of Patents and Trademarks*